United States Patent [19]

Argereu

[11] 4,122,653

[45] Oct. 31, 1978

[54] GROMMET FOR ROVING MACHINE

[76] Inventor: William Argereu, Hickory Dr., North Scituate, R.I. 02857

[21] Appl. No.: 822,740

[22] Filed: Aug. 8, 1977

[51] Int. Cl.[2] ..... D01H 7/46; D01H 7/48

[52] U.S. Cl. ..... 57/34 R; 57/115

[58] Field of Search ..... 57/34 R, 115, 106; 242/157 R

[56] References Cited

U.S. PATENT DOCUMENTS

| | | | |
|---|---|---|---|
| 2,867,970 | 1/1959 | Richter | 57/115 |
| 2,878,637 | 3/1959 | Bacon | 57/115 |
| 3,447,303 | 6/1969 | Loepfe | 57/115 |
| 3,498,040 | 3/1970 | Argereu | 57/115 |

FOREIGN PATENT DOCUMENTS

| | | | |
|---|---|---|---|
| 785,485 | 10/1957 | United Kingdom | 57/115 |

*Primary Examiner*—Charles Gorenstein

*Attorney, Agent, or Firm*—Barlow & Barlow

[57] ABSTRACT

A grommet for leading the roving to a flyer of a roving machine which grommet is composed of an oil impervious plastic material which may be molded and which has an upwardly flaring opening with a friction means therein for contacting the roving. The conical outer surface is substantially parallel to the conical inner surface of the grommet and fins or ribs project outwardly from the outer surface of the grommet.

1 Claim, 5 Drawing Figures

GROMMET FOR ROVING MACHINE

BACKGROUND OF THE INVENTION

Grommets for directing a roving to a flyer of a roving machine have been formed (in the case of grommets of this sort) as shown in the Argereu Pat. No. 3,498,040 which provided a cylindrical solid block of polyurethane with an opening having a conical inner surface for guiding the roving. It has been found, however, that in injection molding that a certain time lag has to be allowed for a rather solid block of polyurethane to set properly and the length of time necessary for setting the polyurethane of the above said patent slowed up the process considerably.

SUMMARY OF THE INVENTION

I have cut away the solid portion of the grommet above mentioned so that the outer surface is now substantially parallel to the inner conical surface which reduces the polyurethane substantially allowing much quicker processing by the injection molding. However, in cutting away this surface, I found that a recess was provided in which the roving caught, and in order to prevent that, I have provided ribs of substantially the same diameter as the outer surface of the body which will act as a fan to blow away the fibers and also if they should collect, they may be easily removed as the encircling fibers are then about the same size as the diameter of the grommet and may be easily slid off of the grommet.

Accordingly, the grommet has a conical inner surface for guiding the roving and an outer surface substantially parallel to the inner surface but provided with radially extending ribs of a diameter substantially the size of the outer diameter of the upper end of the grommet, also at the lower end of the conical opening there is provided a recess to snap into engagement with a flyer or the like.

DESCRIPTION OF THE PREFERRED EMBODIMENT

Figure 1:
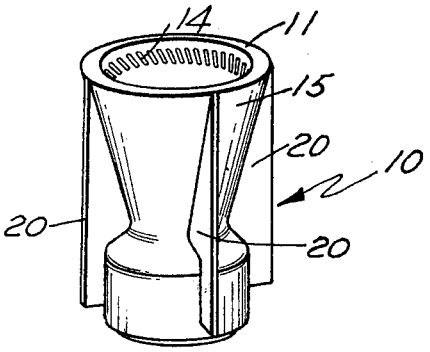
FIG. 1 is a perspective view of the grommet of this invention showing the tapered surfaces and the ribs extending from the outer surface.
Figure 2:
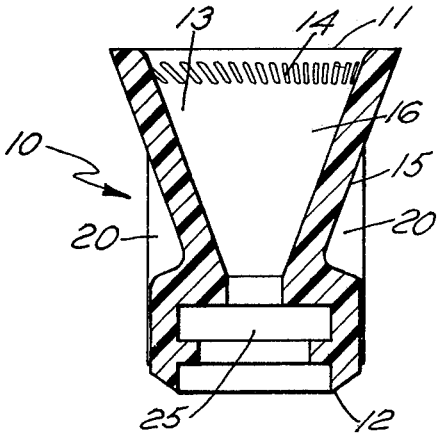
FIG. 2 is a sectional view taken through the grommet between the ribs.
Figure 3:
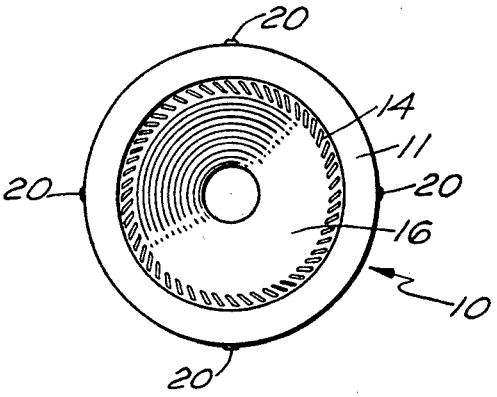
FIG. 3 is a top plan view of the grommet.
Figure 4:
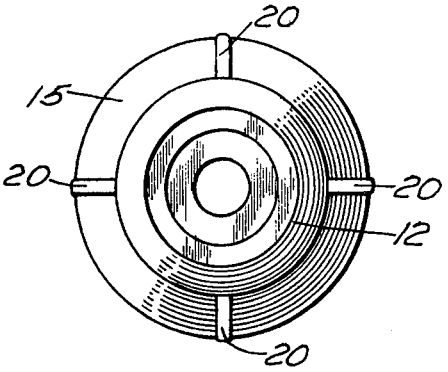
FIG. 4 is a bottom plan view of the grommet.
Figure 5:
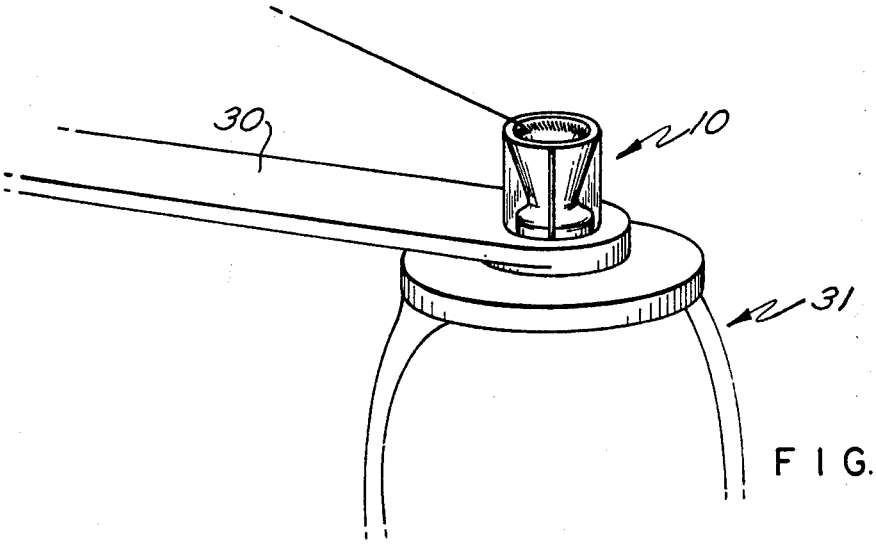
FIG. 5 is a perspective view showing the grommet as attached to a flyer of a roving machine.

Grommets of the present invention comprise generally cylindrical bodies of polyurethane composition having a hole from top to bottom with an inside inverted conical surface terminating within the body at a small lower opening and flaring outwardly at the open upper end. The inner conical surface has a roughened texture of partly spiral ridges at the location between the lower conical surface and the outward upper flare. Referring more particularly to the drawing, the body of the grommet is polyurethane designated 10 and is provided with a top 11 and bottom 12. The hole 13 extends through the grommet from top to bottom and presents an inverted conical surface of the same character as that shown in my U.S. Pat. No. 3,498,040 having a roughened spiral formation as at 14 so as to grip the roving as it passes through the grommet to the flyer as shown in FIG. 5.

The outer surface, however, is designated 15 and is substantially parallel to the inner surface 16 and removes a substantial portion of the polyurethane which was heretofore presented in my earlier U.S. Pat. No. 3,498,040. However, from this outer surface 15 there extends a plurality of ribs 20 here shown as four ribs at equally distant points about the outer circular surface and these ribs as seen more particularly in FIGS. 1 to 4 are of the same radial extent as the outer surface at the upper end designated 11. By reason of this provision of the outer surface much less polyurethane is utilized from a standpoint of the cost thereof while the thickness at any one point while sufficient is thin enough so that the curing of the polyurethane is much speeded up in injection molding making the speed of molding much faster and also by reason of this lesser amount of polyurethane the grommet is much lighter and less expensive. The ribs 20 are provided so that should any thread or roving get wrapped around the grommet, the diameter of this wrapped thread will be such that it may be easily slid off of the grommet over either end thereof.

The recess 25 in the lower portion of the body of the grommet is the same as it was previously in my U.S. Pat. No. 3,498,040 permitting the grommet to be snapped into place in the arm 30 of a roving machine having a flyer 31 as shown in FIG. 5. The grommet with the radial ribs also serves as a fan to keep the fibers away from collecting on the grommet which is a further advantage of these ribs.

The polyurethane which is used has a durometer of 84–A which is found to be very satisfactory.

I claim:

1. A roving machine grommet comprising an oil impervious non metallic body having a top and bottom and a hole therethrough opening into said top and bottom and flaring outwardly from bottom to top along a generally inverted frusto-conical surface, said surface having friction means adjacent its upper end so located as to be contacted by yarn leading to said opening at an acute angle to the axis of said opening greater than the angle of said surface to said axis, the outer surface of said body being generally parallel to the surface of said hole, and ribs extending radially from the inclined outer surface to a point the same as the radius of the outer edge of the top of said body.

* * * * *